US007731733B2

(12) United States Patent
Tesini et al.

(10) Patent No.: US 7,731,733 B2
(45) Date of Patent: Jun. 8, 2010

(54) EXPANDING ORTHOPEDIC PACIFIER

(75) Inventors: David A. Tesini, Hopkinton, MA (US); Joshua Wiesman, Wayland, MA (US)

(73) Assignee: TW Innovations, LLC, Hopkinton, MA (US)

( * ) Notice: Subject to any disclaimer, the term of this patent is extended or adjusted under 35 U.S.C. 154(b) by 626 days.

(21) Appl. No.: 11/459,962

(22) Filed: Jul. 26, 2006

(65) Prior Publication Data

US 2007/0027478 A1 Feb. 1, 2007

Related U.S. Application Data

(60) Provisional application No. 60/702,478, filed on Jul. 26, 2005.

(51) Int. Cl.
*A61J 17/00* (2006.01)

(52) U.S. Cl. ..... 606/236

(58) Field of Classification Search ..... 433/2, 433/6; 606/234, 235, 236
See application file for complete search history.

(56) References Cited

U.S. PATENT DOCUMENTS

| | | | | |
|---|---|---|---|---|
| 2,520,773 | A | 8/1950 | Muller | |
| 4,105,032 | A * | 8/1978 | Blomstedt | 606/236 |
| 4,481,949 | A | 11/1984 | Kesselring et al. | |
| 4,726,376 | A * | 2/1988 | Dahan | 606/234 |
| 4,834,099 | A * | 5/1989 | Schrooten | 215/11.1 |
| 5,013,321 | A * | 5/1991 | MacVane | 606/234 |
| 5,133,740 | A | 7/1992 | Kussick | |
| 5,300,089 | A * | 4/1994 | Sassin | 606/236 |
| 5,570,796 | A | 11/1996 | Brown et al. | |
| 5,772,685 | A | 6/1998 | Crowe et al. | |
| 5,779,071 | A | 7/1998 | Brown et al. | |
| 5,922,010 | A | 7/1999 | Alanen et al. | |
| 6,241,110 | B1 * | 6/2001 | Hakim | 215/11.1 |
| 6,253,935 | B1 | 7/2001 | Fletcher | |
| 6,446,822 | B1 | 9/2002 | Meyers et al. | |
| 6,601,720 | B2 | 8/2003 | Meyers et al. | |
| 6,699,264 | B1 | 3/2004 | Rohrig | |
| 7,029,491 | B2 | 4/2006 | Davis | |
| 2003/0034031 | A1 | 2/2003 | Lev et al. | |
| 2004/0220618 | A1 * | 11/2004 | Rohrig | 606/234 |

FOREIGN PATENT DOCUMENTS

| | | |
|---|---|---|
| FR | 2302724 | 1/1976 |

* cited by examiner

*Primary Examiner*—Ralph A Lewis
(74) *Attorney, Agent, or Firm*—Brian M. Dingman; Mirick, O'Connell, DeMallie & Lougee, LLP

(57) ABSTRACT

An orthopedic pacifier defining a shield adapted to remain outside of the mouth, a bulb adapted to be located in the mouth and on which the child sucks. The bulb is adapted to expand or move upward and outward as the child sucks on it, to counteract inward pressure of the cheeks and the lateral portion of the lips caused by the suction or sucking action.

7 Claims, 12 Drawing Sheets

EXPANDING ORTHOPEDIC PACIFIER

CROSS REFERENCE TO RELATED APPLICATION

This application claims priority of Provisional application Ser. No. 60/702,478 filed on Jul. 26, 2005, the disclosure of which is incorporated herein by reference.

FIELD OF THE INVENTION

This invention relates to an orthopedic pacifier.

BACKGROUND OF THE INVENTION

It is known that maxillary arch constriction can be caused by the inward pressure of the cheeks and the lateral portion of the lips which normally occurs while a child sucks on a pacifier bulb. The American Academy of Pediatrics recommends use of a pacifier through age 12 months. Pacifiers are also commonly used by older children. Although pacifier use has certain health benefits, pacifiers can lead to a narrowed arch and attendant health and appearance issues, which then require correction at a later age. It would thus be quite useful to inhibit or prevent arch constriction due to pacifier usage.

SUMMARY OF THE INVENTION

This invention features an orthopedic pacifier. The pacifier is adapted to produce a force directed upward and outward laterally of the arch midline. The force can be tailored to be less than, essentially equal to, or greater than the inwardly-directed forces created by the child's sucking action. Thus, the inventive pacifier can ameliorate or even correct the arch-narrowing effect that results from traditional pacifier usage.

The inventive pacifier comprises a shield adapted to remain outside of the mouth, a bulb adapted to be located in the mouth and on which the child sucks, and a means, such as a mechanical and/or fluid-drive mechanism, that expands or moves one or more portions of the bulb as the child sucks on the bulb. The upper and lateral portions of the bulb are preferably expandable. For example, the upper portion of the bulb may expand in two or more separate locations. The upper portion of the bulb may expand upward and outward to provide a force that opposes constricting inward forces caused by the sucking action. The expansion means may comprise one or more pivoting structures, which may be pivoting arms; the arms can be separate or integral with the bulb. The expansion means may further comprise a push rod to which the arms are coupled, preferably pivotably coupled. The push rod may be driven at least in part by a diaphragm, and the diaphragm may be moved at least in part by the pressure caused by the child's sucking action. The bulb may define one or more interior ribs to which the arms are coupled. The push rod may be driven at least in part by the tongue, and the expansion means may further comprise a push lever that is moved by the tongue, and causes movement of the push rod.

The expansion means may comprise a means to move fluid located within the bulb, which may be accomplished by a structure that is driven by the tongue, along with a spring to move the structure once the tongue force is withdrawn. The expansion means may comprise a structure located within the bulb and defining one or more protrusions, in which the structure is adapted to be moved in an anterior direction by the tongue.

BRIEF DESCRIPTION OF THE DRAWINGS

Other objects, features and advantages will occur to those skilled in the art from the following description of the preferred embodiments and the accompanying drawings in which.

DESCRIPTION OF THE PREFERRED EMBODIMENTS

This invention features an expanding orthopedic pacifier. The pacifier bulb (the portion that is located in the mouth) expands as the child sucks on it. This helps to prevent maxillary arch constriction caused by the inward pressure of the cheeks and the lateral portion of the lips which normally occurs while a child sucks on a pacifier bulb. The pacifier maintains oro-muscular balance of constricting inward forces and expanding outward forces on the maxillary palate.

The bulb expansion is accomplished by means that cause expansion due to the suction itself and/or the movement of the tongue during the sucking action. Several possible expansion means are described. In one embodiment, the expansion is caused through a series of expansion arms that open up like an umbrella mechanism when the child creates a suction force. The expansion arms urge the outer walls of the bulb against the inside of the mouth, thus counteracting the inward forces. In another embodiment, lateral portions of the bulb are displaced upwardly and outwardly by the sucking action, causing counteracting pressure on the palate. In another embodiment the necessary bulb displacement is accomplished through a hinged mechanism that pushes the bulb upwardly and outwardly as the child clamps on the pacifier. In another embodiment, the bulb is moved by fluid (e.g. air, a gel, or a liquid such as water) pressure caused by the suction force and/or the tongue force as the child sucks the pacifier. Other mechanical means of accomplishing the desired bulb movements are also contemplated herein.

Figure 1A:
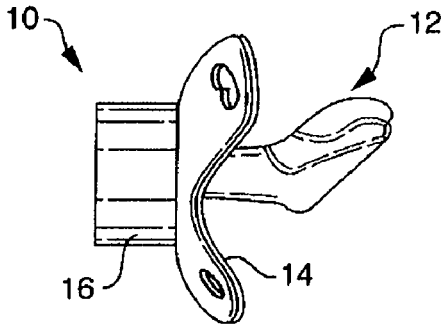
FIG. 1A is a side view, FIG. 1B a top view, FIG. 1C a bottom view, and FIG. 1D an interior view of one preferred embodiment of the invention.
Figure 1B:
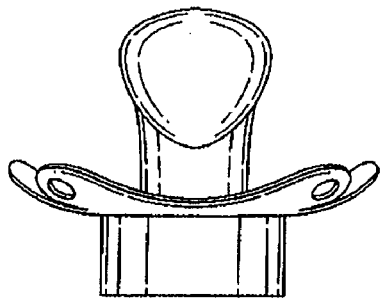
Figure 1C:
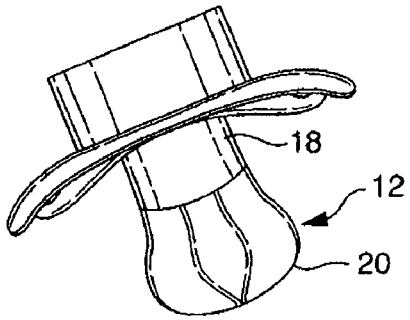
Figure 1D:
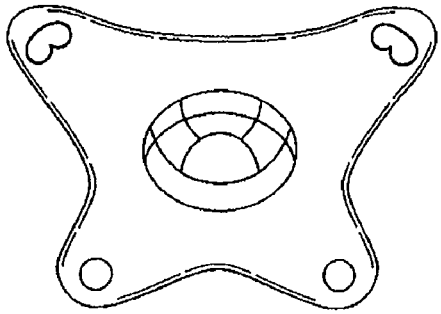
Figure 2:
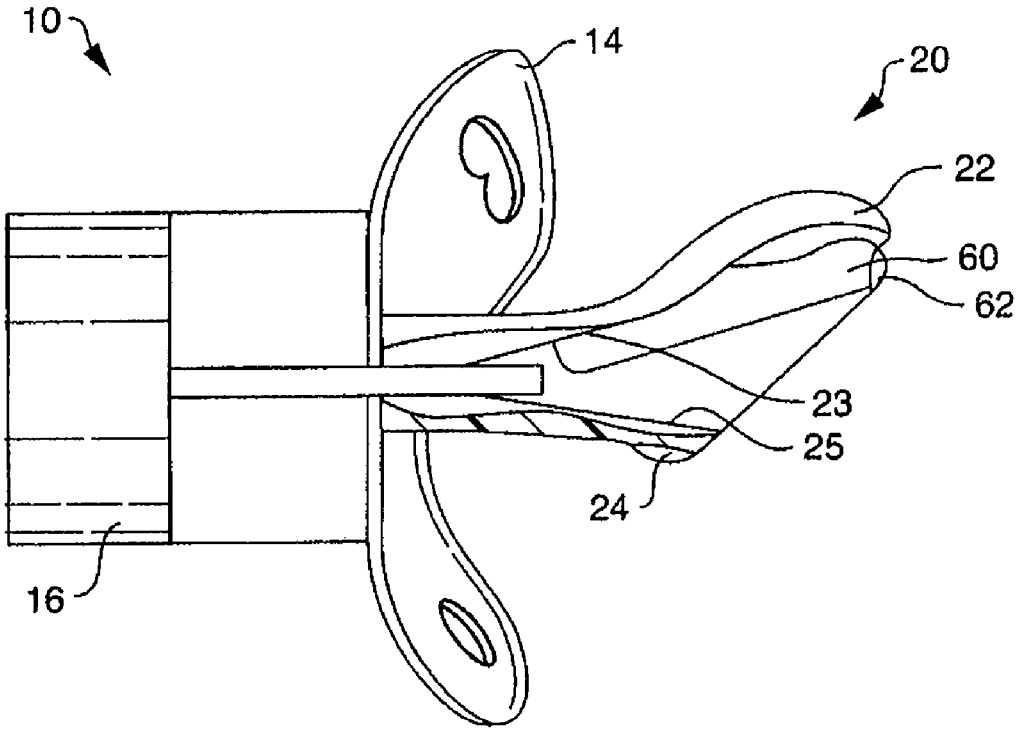
FIG. 2 is a schematic cross-sectional view of the embodiment of FIG. 1.
Figure 3A:
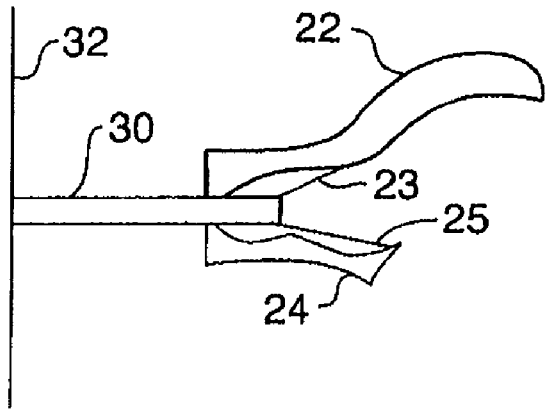
FIGS. 3A and 3B are partial schematic views of the expansion mechanism of the embodiment of FIGS. 1 and 2 in the closed and expanded states, respectively.
Figure 3B:
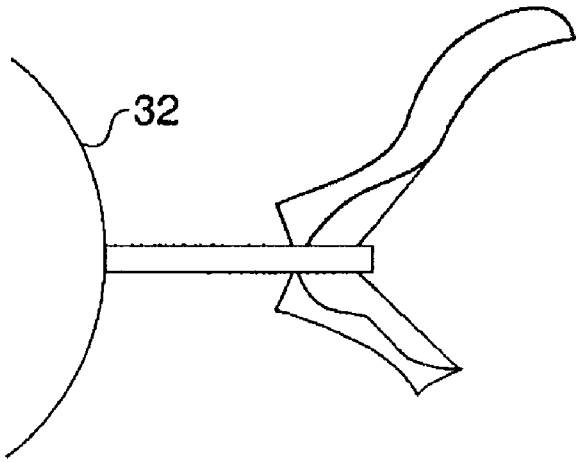
Figure 6:
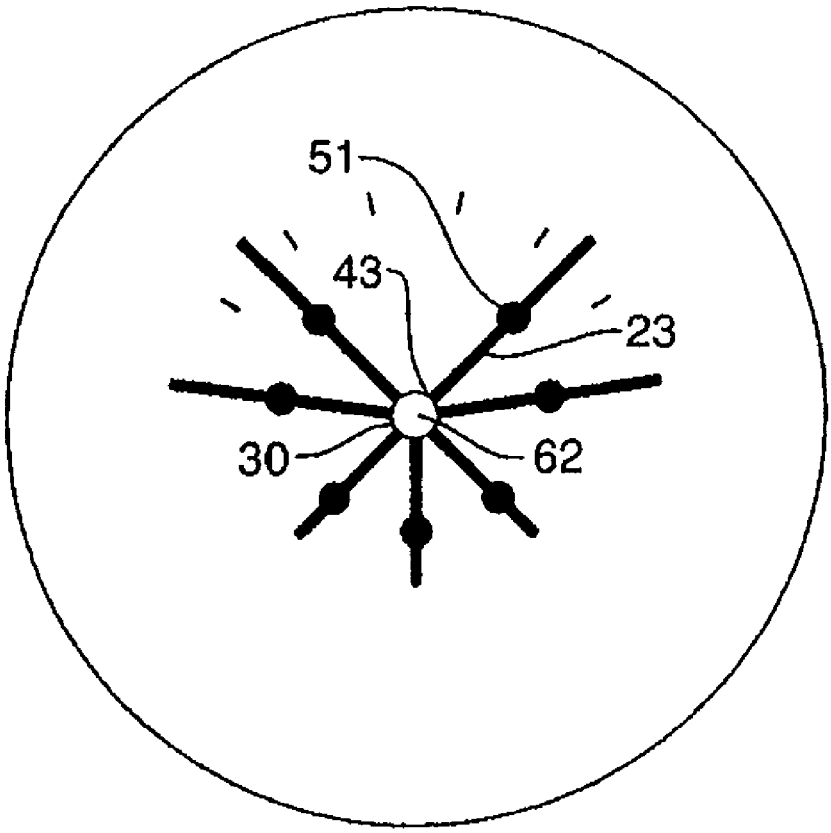
FIG. 6 is a rear (inside) view of the embodiment of FIGS. 1-5.

One preferred embodiment of the invention is shown in FIGS. 1-6. FIG. 1A is a side view, FIG. 1B a top view, FIG. 1C a bottom view, and FIG. 1D an interior view. FIG. 2 is a schematic cross-sectional view. FIGS. 3A and 3B are partial schematic views of the expansion mechanism in the closed and expanded states, respectively. FIGS. 4A and 4B are similar partial schematic views of the expansion mechanism in the closed and expanded states, respectively, showing the forces that accomplish and that tend to counteract the expansion. FIGS. 5A and 5B are more detailed partial schematic views of the expansion mechanism in the closed and expanded states, respectively. FIG. 6 is a rear (inside) view.

Pacifier 10 has portion 12 that is located in the mouth, and shield 14 and anchor portion 16 that are located outside of the mouth. Portion 12 comprises base portion 18 that is coupled to shield 14, and extending distal bulb 20. Bulb 20 is expandable. The expansion in this embodiment is caused by a mechanical means that includes an umbrella-like mechanism comprising a series of expansion arms (one upper expansion arm 23 and one lower expansion arm 25 shown in most drawings). The distal ends of the expansion arms are pushed both upward and outward away from the central axis of the mechanism as follows. Upper arm 23 is flexibly (pivotably) connected by flexure joint 43 at one end to rod 30, and at its distal end by flexure joint 51 to a portion of bulb 20. Lower arm 25 is similarly connected by flexure joints 45 and 53. Rod 30 is connected outside the mouth to diaphragm 32. Rod 30 is a hollow tube, so that as a suction force is created in the mouth, and thus at the tube end located in the mouth, the force cause diaphragm 32 to bow inwardly (see FIG. 5B). This movement causes rod 30 to be pushed farther into the mouth. The expansion mechanism could be molded into (e.g. by insert molding) or otherwise captured directly in the walls of the pacifier bulb.

Figure 4A:
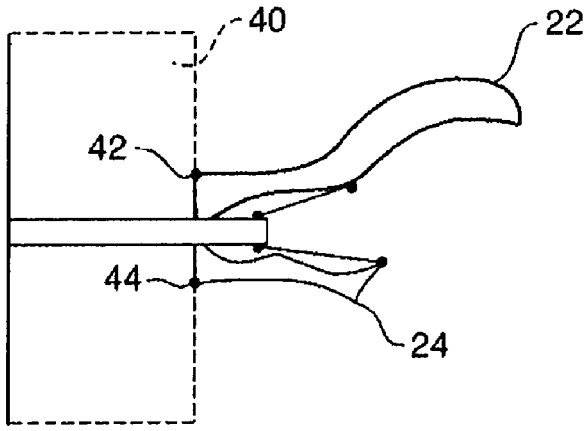
FIGS. 4A and 4B are similar partial schematic views of the expansion mechanism in the closed and expanded states, respectively, showing the forces that accomplish and that tend to counteract the expansion.
Figure 4B:
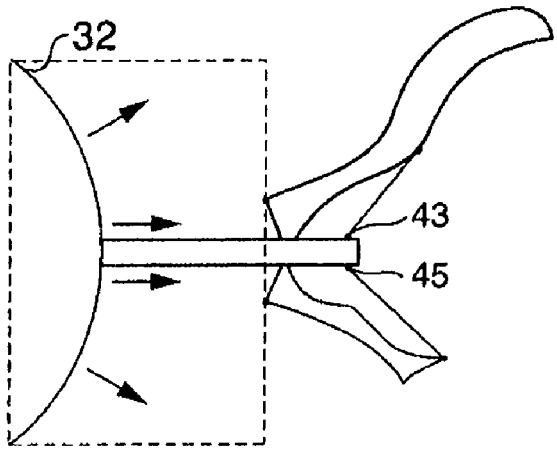
Figure 5A:
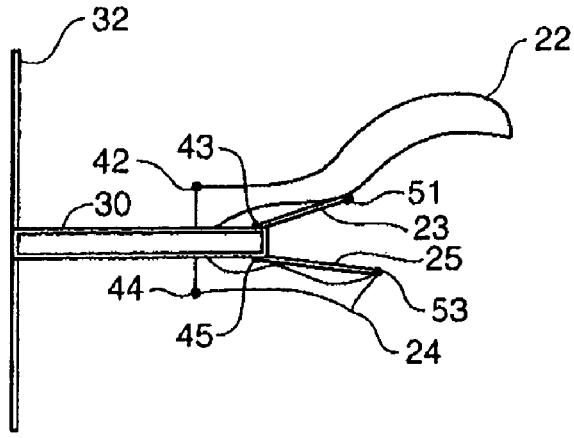
FIGS. 5A and 5B are more detailed partial schematic views of the expansion mechanism in the closed and expanded states, respectively.
Figure 5B:
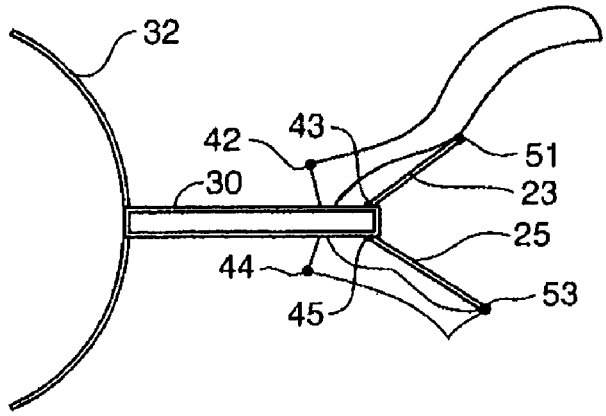

The anterior portion of bulb 20 is fixed to anchor area 40, FIG. 4A (in this example using flexible joints 42 and 44 that are coupled to upper bulb rib 22 and lower bulb rib 24, respectively). Thus, as rod 30 is pushed farther into the mouth, joints 43 and 45 are likewise pushed farther into the mouth. As arms 23 and 25 are fixed to bulb 20, and ribs 22 and 24 of bulb 20 are fixed at their anterior ends to anchor area 40, the inward motion of rod 30 causes the distal ends of the expansion arms to move up and out, causing the same motion of the ribs. Bulb 20 thus is pushed up and out. This pushes the bulb against the palate. The lower ribs (3 in this example) are much smaller than the upper ribs (4 in this example). They provide a counter force against the tongue, which moves forward during a sucking motion (see force arrows in FIG. 4B). This helps to balance the forces of the system. The lower ribs are both structural support and stabilization for the pacifier.

The upper ribs may comprise a thin, rigid polymer that is contoured to the shape of the pacifier bulb. The expansion arms may also be made of a strong rigid polymer. The tube may also be made of a strong rigid polymer. The tube acts as both a center rod and stabilization piece for the mechanism. The diaphragm must be large enough in area to transfer the suction pressure energy to mechanical energy, preferably at a 1:1 relationship, so that the outward force placed on the teeth and palate is at least equal to the suction force.

In one embodiment, the suction is transferred to the diaphragm by placing a one-way valve or vent opening 62 at the posterior end of an opening that leads to the diaphragm (this may be the end of tube 30, or at the end of an interior open area 60 of bulb 20). In addition the venting acts as a more streamlined pathway for air circulation, reducing the risk of apnea.

Ideally, bulb 20 has sufficient flexibility so that it can expand in the manner described without the need for any openings in the bulb. This can be accomplished with appropriate stretchy materials such as those disclosed in U.S. Pat. No. 6,253,935, or with other constructional techniques such as with folding, accordion-like or umbrella-like construction, or by altering thicknesses of materials in specified areas of the bulb.

The pacifier can be constructed to deliver different forces (e.g. applying forces to particular locations in the mouth) by designing different internal mechanisms, and composition and thicknesses of materials. In most cases, what is desired is to design the pacifier such that portions of the bulb push up and out against the arch as the child sucks. The mechanism and materials can be chosen to achieve a desired result. The extent of the force can be designed to partially or fully counteract, or even exceed, suction-induced, inwardly-directed forces, to achieve a desired health benefit. One manner in which the extent of the force can be tailored is through diaphragm design. Similarly, the locations of, and/or extent of expansion motion can be designed to achieve a desired result. These design factors allow the development of a pacifier that can be used with a child of a particular age, or to achieve a desired health benefit such as correction of an existing problem caused by the use of standard pacifiers.

Figure 7:
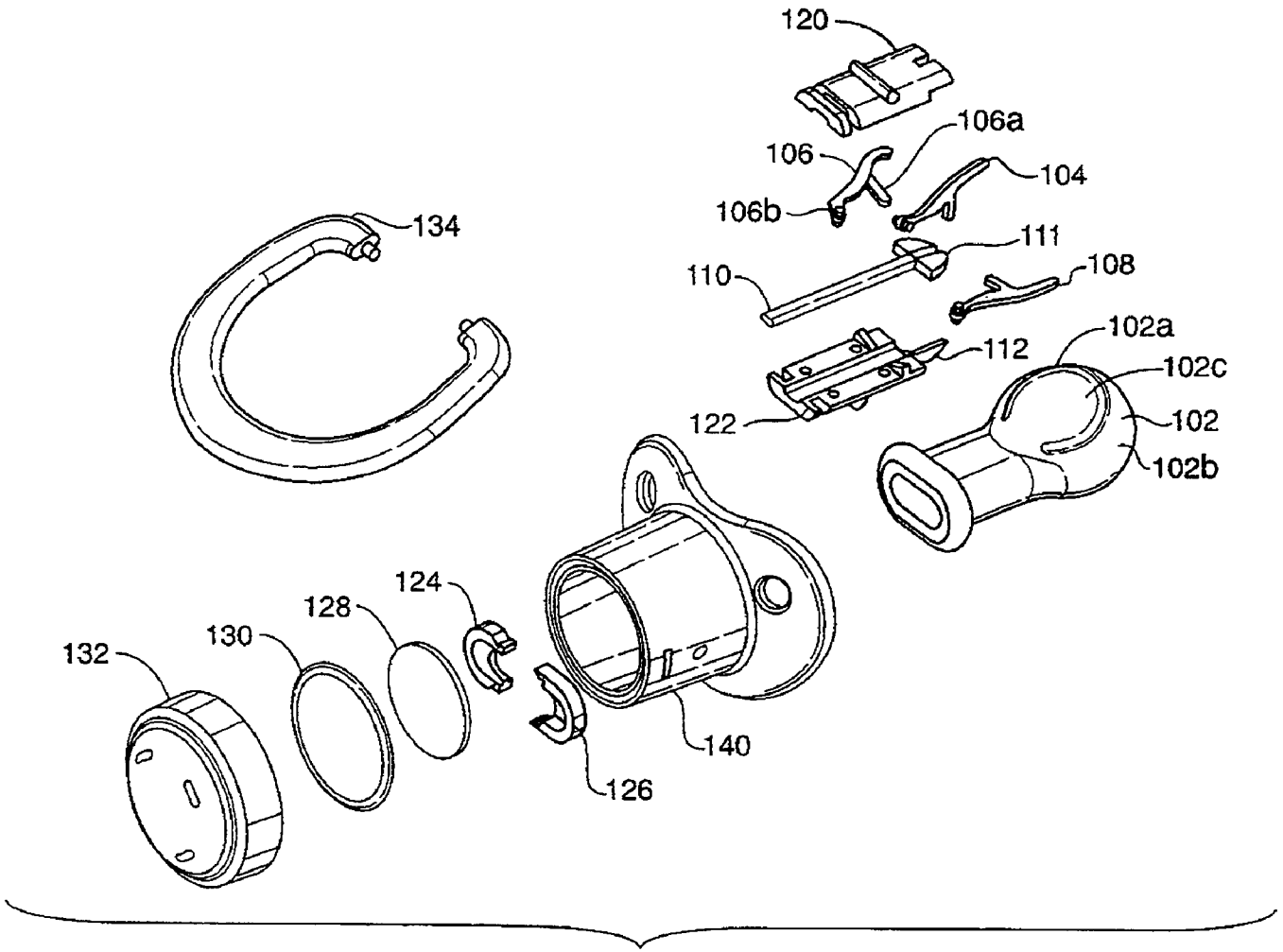
FIG. 7 is an exploded view of another preferred embodiment of the invention, which is similar in operation to the embodiment of FIGS. 1-6.
Figure 8:
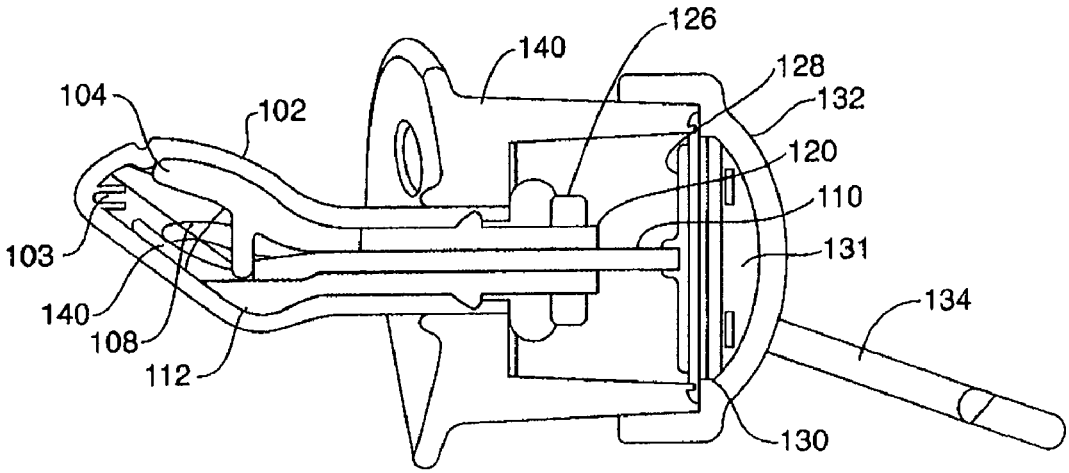
FIG. 8 is a cross-sectional view of the embodiment of FIG. 7.

An alternative construction that operates on the same mechanical principle as the embodiment of FIGS. 1-6, is shown in FIGS. 7 and 8. Pacifier 100 comprises bulb 102 that is constructed such that it can be expanded upward and outward against the arch in the areas labeled as 102*a*, 102*b* and 102*c*. Lever arm 106 causes expansion in area 102*a*, lever arm 108 causes expansion in area 102*b*, and upper lever arm 104 causes upward expansion in area 102*c*. Smaller lower expansion arm 112 provides the counterbalance force as described above. Push rod 110 in this case includes enlarged end 111 that carries or defines cams that engage with lever arm projecting portions, such as portion 106*a* of lever arm 106. The lever arms pivot as described above. For example, level arm 106 pivots about pivot structure 106*b*. The lever arms and push rod are captured in a housing comprising upper half 120 and lower half 122 that can snap or otherwise fit together, and are held in place by half rings 124 and 126. Body 140 also contains disc 128 with which push rod 110 is engaged, and diaphragm 130 that provides the force that moves push rod 110 farther into the mouth as the child sucks on the pacifier bulb. Cap 132 encloses the mechanism, and handle 134 is provided so that the pacifier can be easily grasped, Posterior venting opening 103 and tube 140 that leads to area 131 behind diaphragm 130 are shown in FIG. 8.

Figure 9A:
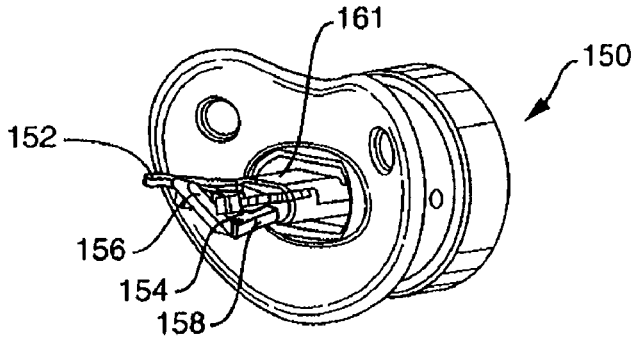
FIGS. 9A, 9B and 9C are isometric, top and cross-sectional views, respectively, of the mechanical expansion mechanism of another embodiment of the invention.
Figure 9B:
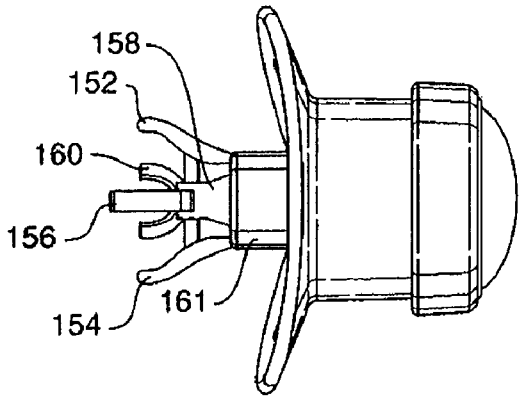
Figure 9C:
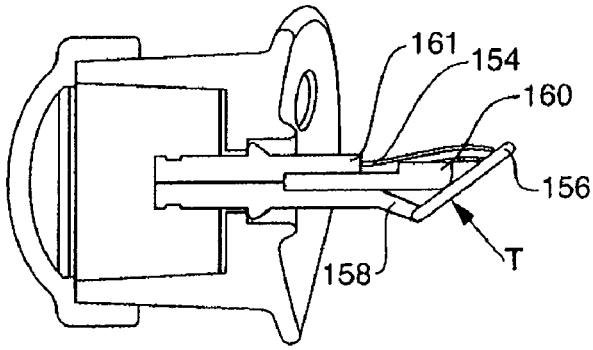

FIGS. 9A-9C show another similar embodiment 150 with a similar lever arm expansion mechanism, but in this case being driven by tongue force instead of (or in addition to) the force caused by suction. Embodiment 150 includes lever 156 that pivots about anchor member 158 and is driven upward and outward by the tongue force in direction "T", to cause cam 160 to be pushed in the direction out of the child's mouth. Cam 160, which is held by mechanism 161, forces lever arms 152 and 154 outward, to expand the pacifier bulb (not shown in these drawings), as described relative to the other embodiments. The opposite end of cam 160 is attached to the diaphragm, which pushes the cam back to the resting position shown in the drawings once the tongue force is released. This way, the bulb expansion is caused by motion of the tongue that goes along with the sucking action. Bulb expansion thus counteracts the inward suction force each time that a suction action occurs.

Figure 10:
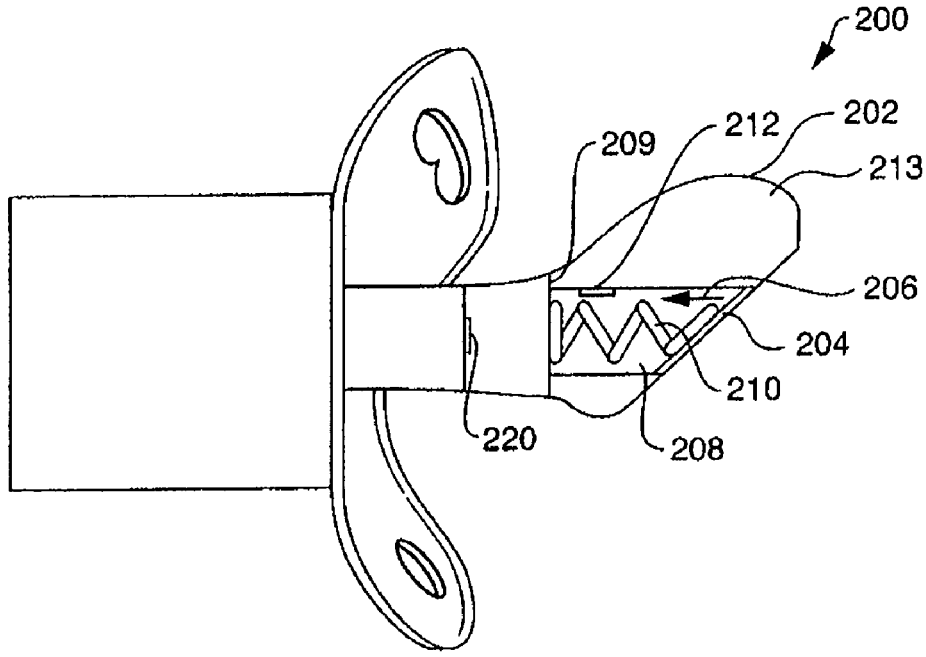
FIG. 10 is a schematic side cross sectional view of another embodiment of the invention.

FIG. 10 is a highly schematic view of another embodiment in which fluid is used to create the expansion or inflate the bulb. The fluid can be a gas such as air, a gel, or a liquid such as water. This embodiment includes plate 204 that is moveable in the anterior direction as shown by arrow 206 within chamber 208 that is anchored to anchor member 209. As the child sucks on bulb 202, the child's tongue pushes member 204 in the direction of arrow 206, which forces the fluid located in chamber 208 out of valve 212 into hollow bulb area 213. The increased pressure in area 213 causes the bulb to expand in this region. Spring 210 returns plate 204 to the resting position shown in FIG. 10 when the infant stops sucking on the bulb. This also causes the fluid to move back into chamber 208 through two way valve 212 in order to equalize the pressure, thus causing the bulb to deflate back to its unpressurized resting position.

Bulb 202 is designed with a number of separate expansion chambers, each communicating with chamber 208 through a valve such as valve 212, to accomplish the desired expansion of the bulb. For example, in order to mimic the upward and outward expansion of the bulb as described above, bulb 202 can have three separate expansion zones that mimic the motion of the three upper lever arms shown in the embodiments above. Another manner to cause expansion is to include valve 220 that can be accessed by a pump operated by an adult, for manual inflation of the bulb. The pump could be a small syringe bulb with a tube that engaged with valve 220, or it could be a built-in pump, for example a movable pumping diaphragm at the outer end of anchor portion 16, FIG. 2.

Figure 11:
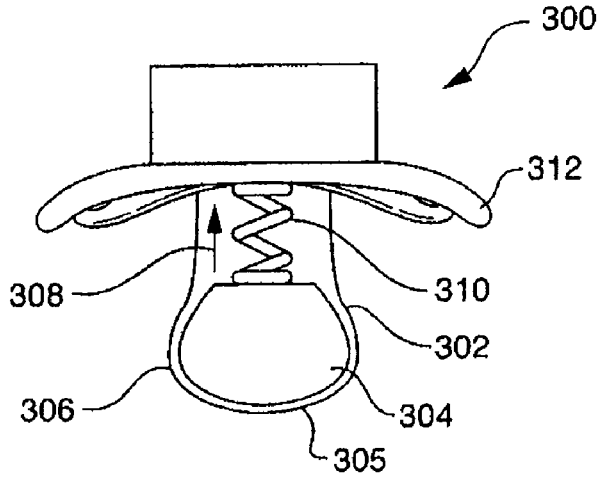
FIG. 11 is a schematic top cross sectional view of another embodiment of the invention.

Another means that accomplishes bulb expansion as the child sucks on the pacifier is shown in FIG. 11 in which mechanical member 304 is located within bulb 302. Member 304 has protrusions placed in strategic locations to accomplish a desired bulb expansion: in this case, illustrative protrusions 305 and 306 are shown. As the infant sucks on bulb 302, the tongue pushes member 304 in the anterior direction as shown by arrow 308. This displaces protrusions 305 and 306 such that they expand bulb 302 where it overlies these protrusions, such that it pushes up against the arch in the desired locations. When the tongue force is removed, spring 310 returns member 304 to the rest position shown in the drawing. Spring 310 can be coupled to shield member 312 of pacifier 300.

Figure 12A:
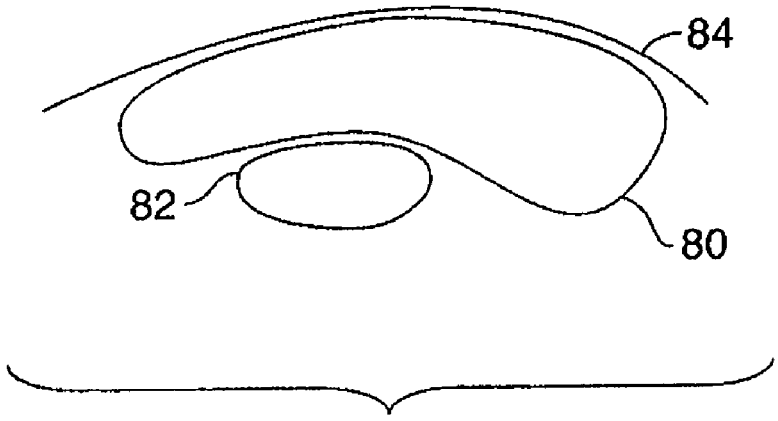
FIGS. 12A and 12B are schematic cross sectional views of another embodiment of the invention before and after engagement by the tongue, respectively.
Figure 12B:
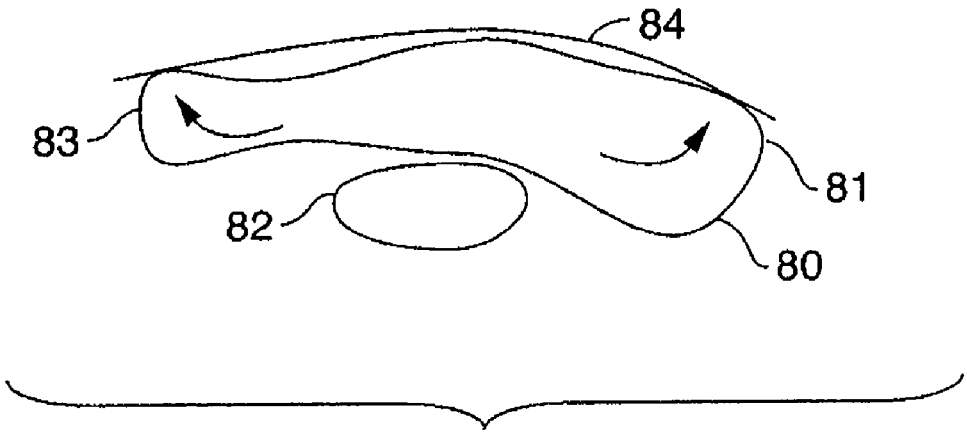

Another embodiment contemplates a more passive motion of the pacifier bulb. For example, as shown schematically in FIGS. 12A and 12B (which do not show the shield or any portions of the pacifier other than the bulb), the bulb can be more elongated in the transverse direction, and when the tongue is pushed up against the bulb during a sucking action, the lateral portions of the bulb preferably push out and up. This could be accomplished with an internal structural mechanism, or through the use of materials having different reactions to the created forces, such that the lateral ends expand more than the middle as the tongue force is applied (e.g., a stretchier material at the lateral ends, or internal stiff disks inside the lateral portions that are pushed out by the suction/tongue forces, or by alteration of material thicknesses). The intraoral pressure caused during a suction action may also contribute to the overall motion of the bulb.

Another possibility would be to use a "clothes pin"-like hinged mechanical mechanism of the type disclosed in U.S. Pat. No. 5,133,740, to move portions of the bulb due to the clamping force of the teeth and lips on the pacifier. Other mechanical means of similar types that push a portion of the pacifier bulb against the palate upon suction by the child, are also within the scope of this invention.

Figure 13A:
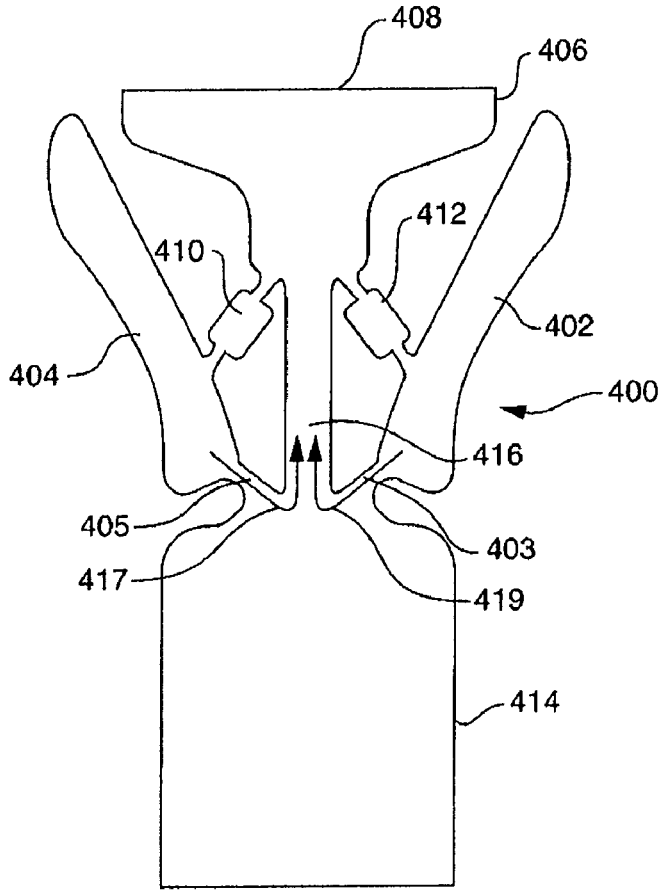
FIGS. 13A and 13B are highly schematic cross sectional views of another embodiment in which fluid pumped by the tongue creates the force that causes the expansion motion.
Figure 13B:
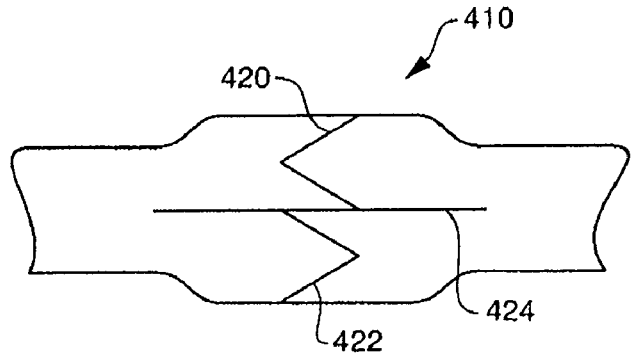

The active elements of a more specific construction, that acts through fluid displacement in a manner similar to that of the embodiment of FIG. 10, is shown in FIGS. 13A and 13B. Expanding pacifier 400 includes expansion arms 402 and 404, which have a suction force counteracting effect much as accomplished by the embodiments shown in FIGS. 1-10. This construction essentially inflates and deflates during sucking by the child, as a fluid such as air or perhaps water is pumped into and out of expansion arms 402 and 404 by the child's tongue during the sucking action. Expansion arms 402 and 404 are adapted to expand (e.g. by being made of a flexible material such as an elastomer) and/or are adapted to move mechanically (e.g. by means of an expansion chamber that pushes out on pivoting expansion arms) upon the fluid being pumped by the tongue. In this example, compressible pumping chamber 406 is compressed through the tongue acting on surface 408. This compression causes fluid in chamber 408 to move through valving chambers 410 and 412 into expansion arms 404 and 402, respectively. Valving chambers 410 and 412 may accomplish two-way flow through oppositely directed one-way valves, such as shown in FIG. 13B, in which wall 424 divides chamber 410 into two separate one-way ducts, each one having a one-way valve, as shown with valves 420 and 422. The valves, which can be simple tricuspid flap valves or the like, allow the fluid to move from chamber 408 into arms 402 and 404 when the child's tongue compresses chamber 408 during a suction action, and also allow the fluid to return to chamber 408 when the force is removed. Note that in order to accomplish this embodiment, valving 403, 405 and 416, and chamber 414, all described below, may not be needed.

Other options for accomplishing this fluid movement are shown in FIG. 13A. In one option, there could be additional one-way valves in locations 403, 405 and 416 that allowed fluid to flow in the direction of arrows 417 and 419 to return fluid from the expansion arms to chamber 408. In this case, there would only need to be one valve in locations 410 and 412. Fluid storage chamber 414 (which would likely be located outside of the mouth) could be included in order to pre-load chamber 408 and provide the volume and force balancing that would help to achieve proper fluid flow. Chamber 414 could also be pumped manually in order to properly inflate (i.e. load) chamber 408, to create a desired motion of arms 402 and 404 for a particular child. Manually operated venting to the atmosphere could be included to allow fluid pressure release. This could be accomplished through a manually operated valve in a wall of chamber 44, for example.

Since certain changes that would be apparent to one skilled in the art may be made in the above described embodiments of the invention without departing from the scope thereof it is intended that all matter contained herein be interpreted in an illustrative and not a limiting sense.

Other embodiments will occur to those skilled in the art and are within the following claims.

What is claimed is:

1. An orthopedic pacifier that creates upward and outward forces on the maxillary palate laterally on each side of the arch midline as the child sucks on the pacifier, the pacifier comprising:

a shield adapted to remain outside of the mouth;

a bulb adapted to be located in the mouth and on which the child sucks, the bulb defining a base portion that is coupled to the shield, and a closed hollow flexible posterior bulbous portion defining a bulb wall upper section to be located proximate the palate; and structures located at least partially inside the bulbous portion that as the result of a sucking action produce a force directly on the inside of the bulb wall upper section in at least two separate locations of the bulb wall upper section, one on each side of the arch midline, to push the bulb wall upper section against the palate and thereby create upward and outward forces on the maxillary palate laterally on each side of the arch midline as the child sucks on the pacifier, in which the structures comprise elongated pivoting members that are in contact with the inside of the bulb wall at the at least two separate locations.

2. The orthopedic pacifier of claim 1 in which the pivoting members comprise pivoting arms that define distal arm ends that are in contact with the inside of the bulb wall.

3. The orthopedic pacifier of claim 2 in which the structures further comprise a movable push rod to which the pivoting arms are pivotably coupled, wherein the push rod moves posteriorly within the bulbous portion during a sucking action, causing the distal ends of the pivoting arms to pivot outward and thus produce the outwardly-directed force on the inside of the bulb wall.

4. The orthopedic pacifier of claim 3 in which the structures further comprise a diaphragm that is located outside of the mouth and to which the push rod is coupled, and in which the push rod is driven posteriorly at least in part by the diaphragm.

5. The orthopedic pacifier of claim 4 in which the diaphragm is moved posteriorly at least in part by the pressure caused by the child's sucking action.

6. The orthopedic pacifier of claim 5 in which the bulb defines interior ribs to which the distal ends of the pivoting arms are pivotably coupled.

7. The orthopedic pacifier of claim 2 in which the structures further comprise a push lever that is moved by the tongue in an upward and anterior direction during a sucking action, in which the pivoting arms are pivotably coupled to the push lever such that when the push lever is moved by the tongue the distal ends of the pivoting arms pivot outward and thus produce the outwardly-directed force on the bulb wall.

* * * * *